US005854650A

United States Patent [19]

Kobori et al.

[11] Patent Number: 5,854,650

[45] Date of Patent: Dec. 29, 1998

[54] FIELD EMISSION PRINT HEAD

[75] Inventors: Yoichi Kobori; Yukihiko Shimizu; Kinya Ueda, all of Mobara, Japan

[73] Assignee: Futaba Denshi Kogyo K.K., Mobara, Japan

[21] Appl. No.: 671,193

[22] Filed: Jun. 27, 1996

[30] Foreign Application Priority Data

Jun. 28, 1995 [JP] Japan ..... 7-183309

[51] Int. Cl.[6] ..... B41J 2/415; B41J 2/435

[52] U.S. Cl. ..... 347/122; 313/494

[58] Field of Search ..... 347/115, 121, 347/122, 127, 128, 237, 238; 313/446, 422, 447, 448, 496, 494; 315/167, 169.1; 361/777

[56] References Cited

U.S. PATENT DOCUMENTS 4,757,234 7/1988 Ikuta et al. ..... 313/496

5,606,358 2/1997 Beaman ..... 347/237

5,625,253 4/1997 Van Gorkom et al. ..... 313/422

*Primary Examiner*—N. Le

*Assistant Examiner*—L. Anderson

*Attorney, Agent, or Firm*—Oblon, Spivak, McClelland, Maier & Neustadt, P.C.

[57] ABSTRACT

Field-emitted electrons are converged by a structure according to the present invention in which odd order gate lines are connected to a first gate lead electrode, while even order gate lines are connected to a second gate lead electrode. When the first gate lead electrode is selected and operated, the potential of the second gate lead electrode is made to be a low level. Since the odd order gate line is disposed between low level even order gate lines, emitted electrons can be converged. When the second gate lead electrode is selected and operated, a contrary process is performed so that emitted electrons are converged. Each gate line has three dot-like field emission arrays, which correspond to red, green and blue color components, so that color image apparatus is structured.

3 Claims, 7 Drawing Sheets

DISPLACEMENT AMOUNT △y FROM CENTER LINE AND IRREGULARITY OF LIGHT QUANTITY (LENS ARRAY CONSISTING OF LENSES ARRANGED INTO SIGNAL LINE)

DISPLACEMENT AMOUNT △y FROM CENTER LINE AND IRREGULARITY OF LIGHT QUANTITY (LENS ARRAY CONSISTING OF LENSES ARRANGED INTO TWO LINES)

FIELD EMISSION PRINT HEAD

BACKGROUND OF THE INVENTION

1. Field of the Invention

The present invention relates to a print head adaptable to an optical printer, and more particularly to a field emission color print head having a field emission device.

2. Related Art

Hitherto, optical printers have been known. The schematic structure of the optical printer will now be described with reference to FIG. 1. A film 120 is coated with a sensitive material, such as silver halide (silver salt), so as to be exposed to light when the lower surface of the film 120 is irradiated with light reflected by a mirror 121.

The film 120 is irradiated with light emitted from a print head 125. The print head 125 is supplied with image data for each line. Light modulated by image data above is main-scanned vertically on the surface of the sheet and the print head 125 is sub-scanned as indicated by an arrow shown in FIG. 1 so that one image is printed on the film 120 by a line sequential method.

Reference numeral SLA 122 represents a SELFOC lens array serving as a lens for causing light emitted from the print head 125 to be focused on the surface of the film 120. A mirror 123 introduces light into the SLA 122.

An RGB filter 124 is an optical filter of three primary colors for printing a color image on the film 120. In a case where a color image is printed, image data for one line is decomposed into R, G and B image data, and then the RGB filter 124 is moved to correspond to image data for each color so that the RGB filter 124 performs the main scanning operations. That is, the main scanning operations performed by three times result in the color image for one line being displayed on the film 120.

An optical printer of the foregoing type has a light source which has been a light emitting diode (LED) or a fluorescent character display tube of a thermionic emission type. In recent years, use of semiconductor microprocessing technique has enabled micron size field emission devices to be formed into an array configuration on a substrate. A field emission print head using the foregoing field emission device array as the electron source has been suggested (refer to Japanese Patent Laid-Open No. 4-43539).

An example of the structure of a conventional field emission print head of the foregoing type is shown in FIG. 2. In FIG. 2, FIG. 2A is a schematic plan view, FIG. 2B is a schematic cross sectional view taken along line A–A' shown in FIG. 2A, and FIG. 2C is a detailed cross sectional view taken along line B–B' shown in FIG. 2A. As shown in FIG. 2, the field emission print head has a first flat substrate 101 having a plurality of field emission devices 105 formed thereon, a second flat substrate 102 disposed opposite to the first flat substrate 101 and having a fluorescent member 106 and so forth formed thereon, a holder member 103 for maintaining a predetermined distance from the first flat substrate 101 to the second flat substrate 102, and a vacuum layer 104 surrounded by the first flat substrate 101, the second flat substrate 102 and the holder member 103.

The first flat substrate 101 is made of an n-type silicon single crystal substrate and covered with a silicon oxide film ($SiO_2$ film) 101' except the field emission devices 105 and the substrate contact electrode 107 thereof. The second flat substrate 102 is made of a transparent glass substrate and having a transparent anode electrode 109 and a fluorescent member 106 laminated on the surface thereof. The field emission devices 105, each having a cathode electrode and a gate electrode, and the fluorescent member 106, having an anode electrode, are disposed to opposite to each other in such a manner that a vacuum layer 104 is formed between the field emission devices 105 and the fluorescent member 106. A pair of the field emission device 105 and the fluorescent member 106 form a unit light source. Each unit light source has one field emission device sectioned by gate electrodes separated from one another and disposed in the form of an array. The cathode electrode of each of the field emission device shares a monocrystal silicon plate. Also the anode electrode is commonly shared.

One field emission device, as shown in FIG. 2C, has a plurality of projecting cathode electrodes (emitters) 111 formed on the surface of the first flat substrate 101 and gate electrodes 112 formed on the $SiO_2$ film 101' and having openings adjacent to the foregoing projections. The gate electrodes are separated from one another by each field emission device.

Although the first flat substrate 101 is made of the single crystal silicon substrate and the projections are formed by anisotropic etching of the single crystal silicon substrate, an insulating substrate having metal electrodes and metal projections may be employed or a structure having metal projections formed on a conductive substrate may be employed.

In the thus-structured unit light source in a state where the single crystal silicon substrate 101 is grounded through the substrate contact electrode 107, when anode voltage $V_{ak}$ is applied to the fluorescent member 106 through the anode contact electrode 110 and the anode electrode 109 and gate voltage $V_{gk}$ is applied to the gate electrode of the field emission devices 105 through the gate contact electrode 108, the electric field of the gate electrode is applied to the projection portions of the cathode electrode of the field emission devices 105 so that electrons are field-emitted from the leading portions of the projections. The field-emitted electrons are accelerated due to the anode voltage when allowed to reach the fluorescent member 106 so that the portions of the fluorescent member 106 opposite to the device emit light.

Thus-emitted light passes through the transparent anode electrode 109 and the second flat substrate 102 and radiated so that image data for one line is emission-recorded on a recording medium, such as a film. In the foregoing case, the line sequential scan method may be employed as described above, in which the recording medium or the print head is moved to record image data for the following one line.

Since a field emission print head of the foregoing type is manufactured by using the microprocessing technique for semiconductors, high resolutions can be realized.

However, in the foregoing conventional field emission print head, electrons are emitted from the leading ends of the projecting cathode electrodes 111 for field-emitting electrons while being spread by an angular degree of about 60 degrees. Therefore, somewhat spread electrons reach the anode electrode 109. As a result, there is a risk that adjacent pixels on the anode electrode 109 are excited to emit light. Thus, there arises a problem in that the resolution deteriorates and a high quality image cannot be printed due to leakage emission. In a case where the anode electrode 109 is in the form of a patterned flat and solid electrode, the foregoing problems become more critical.

SUMMARY OF THE INVENTION

Accordingly, an object of the present invention is to provide a field emission color print head capable of converging field-emitted electrons.

To achieve the object, according to one aspect of the present invention, there is provided a field emission print head including: a plurality of cathode lines formed on a cathode substrate; a plurality of emitters formed on the cathode lines; a plurality of gate lines formed on the cathode substrate through an insulating layer at positions opposite to the cathode lines, the gate lines being disposed adjacent to leading ends of the plural emitters; a first gate lead electrode to which odd order gate lines among the gate lines are connected; a second gate lead electrode to which even order gate lines among the gate lines are connected; a plurality of anode lines formed on an anode substrate disposed opposite to the cathode substrate; dummy anodes formed on the two sides of the plural anode lines; and fluorescent members covering an anode line portion which is opposite to the gate lines, wherein the first gate lead electrode and the second gate lead electrode are alternately selected and operated, the plural anode lines are sequentially selected and operated, and potentials of non-selected gate lead electrodes, non-selected anode lines and the dummy anode are low levels.

According to another aspect of the present invention, there is provided a field emission print head including: a plurality of cathode lines formed on a cathode substrate; a plurality of emitters formed on the cathode lines; a plurality of gate lines formed on the cathode substrate through an insulating layer at positions opposite to the cathode lines, the gate lines being disposed adjacent to leading ends of the plural emitters; a plurality of converging electrodes between the first gate lines and on the two sides of the first gate lines; a first gate lead electrode to which the plural gate lines are connected; a second gate lead electrode to which the plural converging electrodes are connected; a plurality of anode lines formed on an anode substrate disposed opposite to the cathode substrate; dummy anodes formed on the two sides of the plural anode lines; and elongated fluorescent members covering the anode lines in an axial direction of the anode lines, wherein any one of the plural anode lines is selected and operated to correspond to color image data to be supplied to the cathode lines, and potentials of the second gate lead electrode, non-selected anode lines and the dummy anode are low levels.

The field emission print head has a structure such that the plural anode lines are made of non-transparent conductive materials in such a manner that slits are formed in the axial direction of the anode lines, and the plural anode lines are covered with the fluorescent members to cover the slits.

According to the present invention, the gate lines are separated into the odd order gate lines and even order gate lines so as to be alternately selected and operated. Simultaneously, the plural anode electrodes are sequentially selected and operated. In this case, the potential of the non-selected gate line and the non-selected anode line is made to be a low level (or zero level or a negative level) so that electrons field-emitted from the gate line are not dispersed but the same are converged.

By providing converging gate electrodes, the level of which is always low (or zero level or a negative level), between the plural gate lines, dispersion of field-emitted electrons is prevented so that electrons are converged.

The field emission array is formed into an elongated stripe configuration in the axial direction of the gate lines in place of the dot-like configuration; and the anode lines are coated with the elongated fluorescent members in the axial direction of the anode lines. As a result, the permissible range for positioning the anode substrate with respect to the cathode substrate and the permissible range for positioning the fluorescent members with respect to the anode lines can be widened. Thus, the field emission print head can easily be manufactured.

Since field-emitted electrons can be converged, the pixel pitch can be shortened so that a low cost SELFOC lens is employed.

Other objects, features and advantages of the invention will be evident from the following detailed description of the preferred embodiments described in conjunction with the attached drawings.

DETAILED DESCRIPTION OF THE PREFERRED EMBODIMENTS

Figure 1:
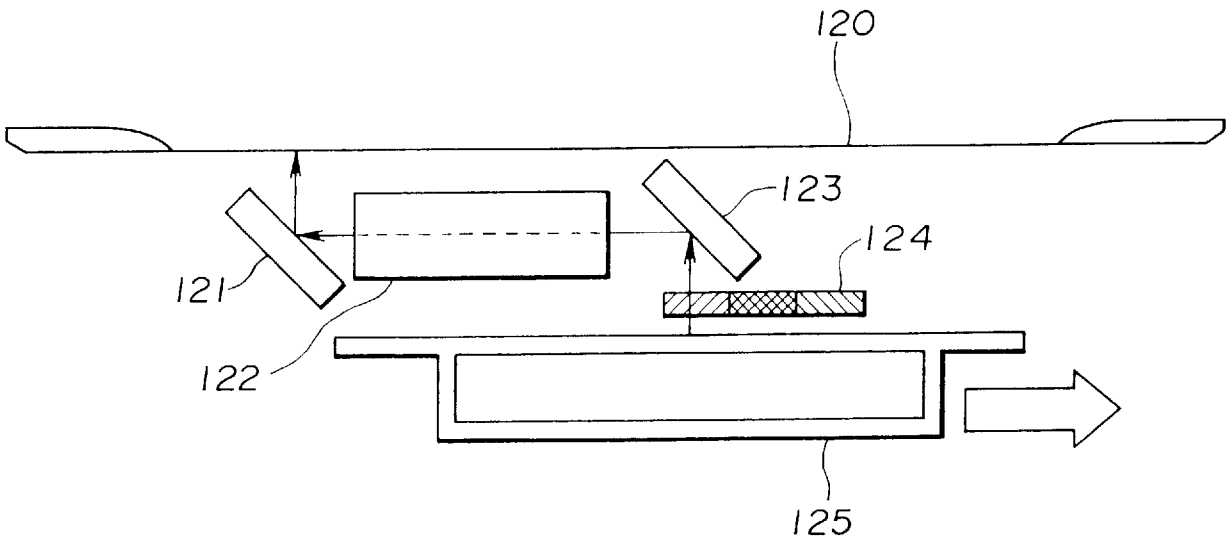
FIG.1 (PRIOR ART)
FIG. 1 is a diagram showing the schematic structure of a conventional optical printer.
Figure 2A:
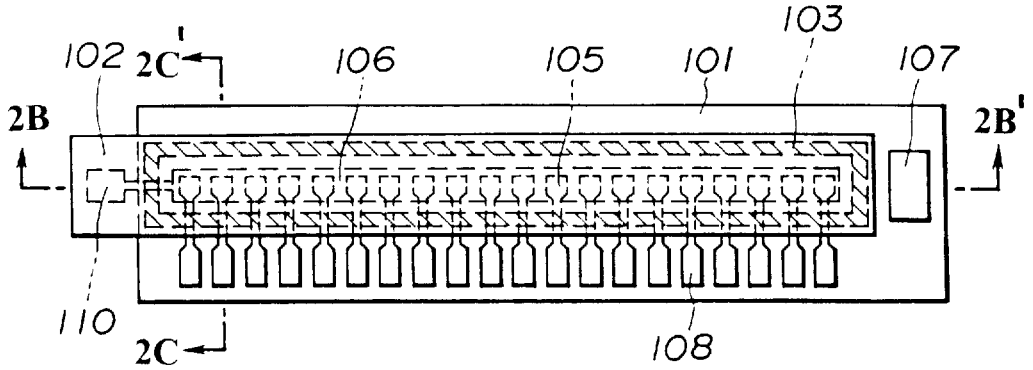
FIG.2A (PRIOR ART)
FIGS. 2A, 2B and 2C include a top view, a front cross sectional view and a side cross sectional view showing the schematic structure of a conventional field emission print head.
Figure 2B:
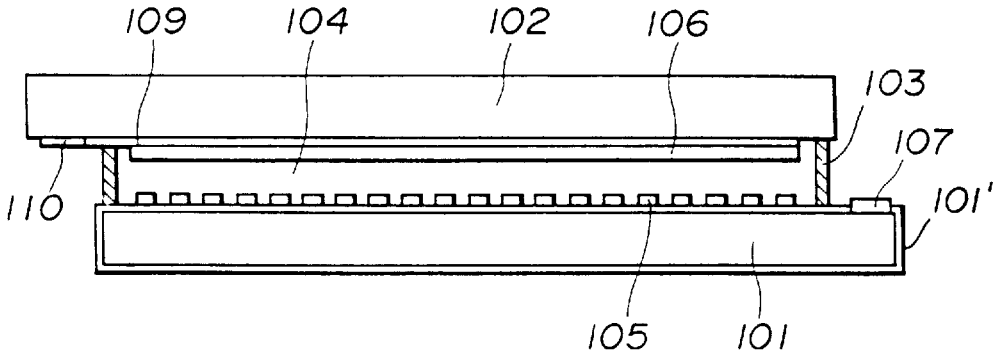
FIG.2B (PRIOR ART)
Figure 2C:
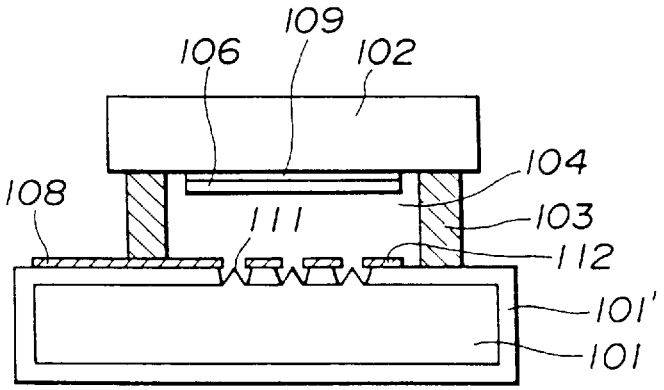
FIG.2C (PRIOR ART)
Figure 3A:
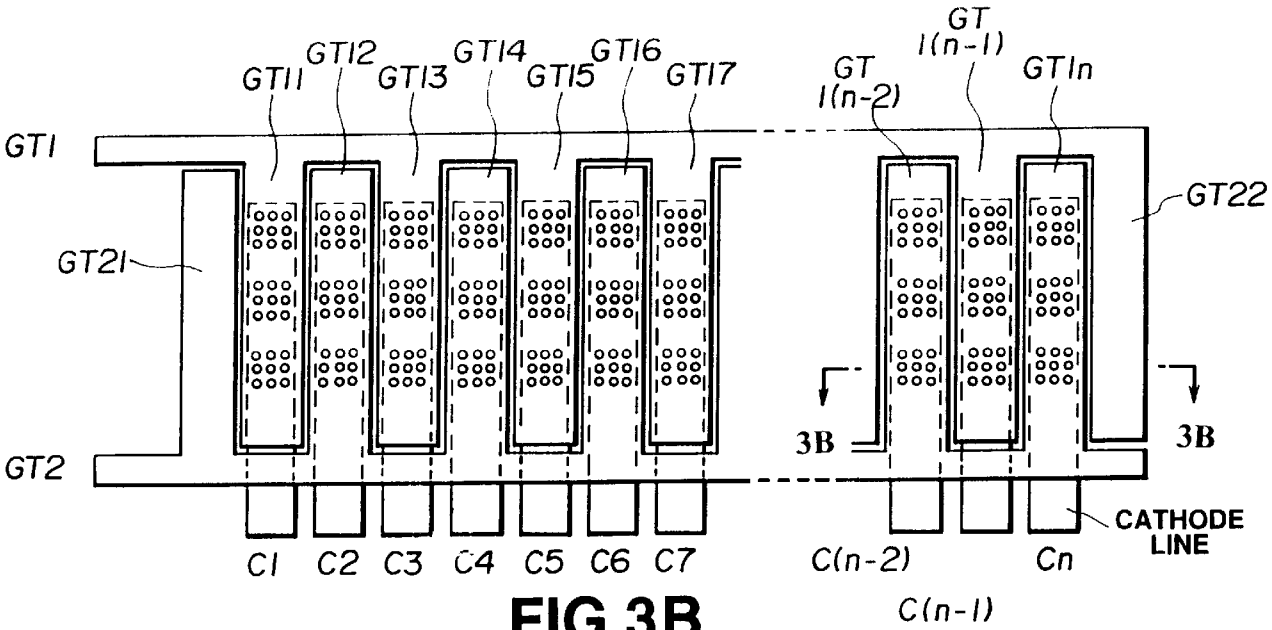
FIGS. 3A, and 3B includes a partial side cross sectional view showing a field emission print head according to a first embodiment of the present invention and the structures of gate lines and cathode lines.
Figure 3B:
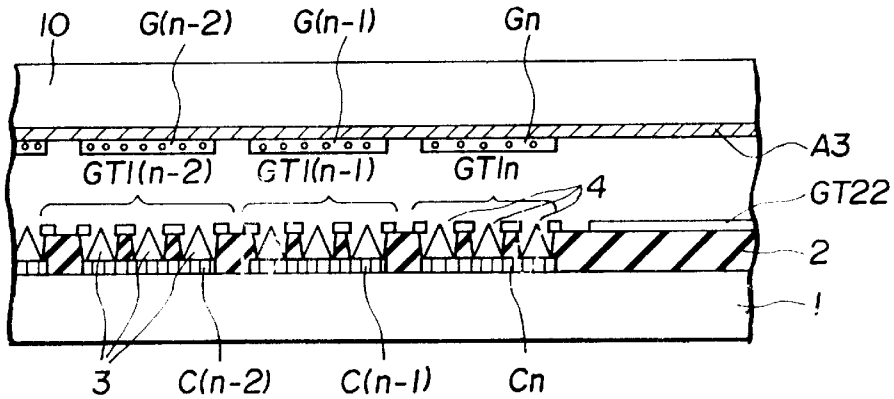

The structure of a first embodiment of a field emission print head according to the present invention is shown in FIG. 3. FIG. 3A shows an example of a gate line pattern when a cathode substrate 1 forming the field emission print head according to the present invention is viewed from an upper position. FIG. 3B shows the cross sectional structure of the field emission print head taken along line A—A shown in FIG. 3A.

As shown in FIG. 3B, a plurality of cathode lines C1, C2, C3, . . . , Cn (only three cathode lines C (n−2), C (n−1) and Cn are illustrated) are formed on one surface of the cathode substrate 1. On the cathode lines C1, C2, C3, . . . , Cn, there are formed a plurality of cone-like emitters 3 for respectively forming field emission arrays. On the cathode substrate 1, there is formed an insulating layer 2 made of for example $SiO_2$ . On the insulating layer 2, there are formed n gate lines GT11 to GT1n (only three gate lines GT1 (n−2), GT1 (n−1) and GT1n are illustrated), and dummy gates GT21 and GT22 disposed on the two sides of the gate lines GT11 to GT1n.

An anode substrate 10 is disposed opposite to the cathode substrate 1 and apart from the same for a predetermined gap. The anode substrate 10 has three stripe-shape anode electrodes A1, A2 and A3 and two dummy anodes A4 on the two sides of the anode electrodes A1, A2 and A3. Moreover, the anode lines A1, A2 and A3 are coated with dot-like fluorescent members (only fluorescent members G (n−2), G (n−1) and Gn covering the anode line A3 are illustrated).

The cathode substrate 1, the anode substrate 10 and side plates (not shown) form a vacuum airtight container, the inside of which is made to be high vacuum. Note that the cathode substrate 1 and the anode substrate 10 are made of glass.

FIG. 3A is a diagram showing the cathode substrate 1 when viewed from an upper position. As shown in FIG. 3A, odd-order gate lines GT11, GT13, GT15, . . . , GT1 (n−1) of the n gate lines GT11 to GTn are connected to a first gate lead electrode GT1, while even-order gate lines GT12, GT14, GT16, . . . , GT1n of the n gate lines GT11 to Gtn are connected to a second gate lead electrode GT2.

The first gate lead electrode GT1 and the second gate lead electrode GT2 are alternately selected and operated. Moreover, the potential of a non-selected gate lead electrode is made to be a low level (or a zero level or a negative level).

When the first gate lead electrode GT1 is selected and operated for example, the potential of each of the gate lines GT12 and GT14 on the two sides of, for example, the gate line GT13 is made to be the low level. As a result, an influence of the thus-formed electric field causes electrons emitted from the gate line GT13 to be converged.

Thus, when the first gate lead electrode GT1 has been selected and operated, electrons emitted from the odd-order gate lines GT11, GT13, GT15, . . . , GT1 (n−1) are converged. When the second gate lead electrode GT2 has been selected and operated, electrons emitted from the even-order gate lines GT12, GT14, GT16, . . . , GT1n are converged.

Since no gate line exists on the outside of each of the gate line GT11 and the gate line G1n, dummy gates GT21 and GT22 are provided to converge electrons.

Figure 4:
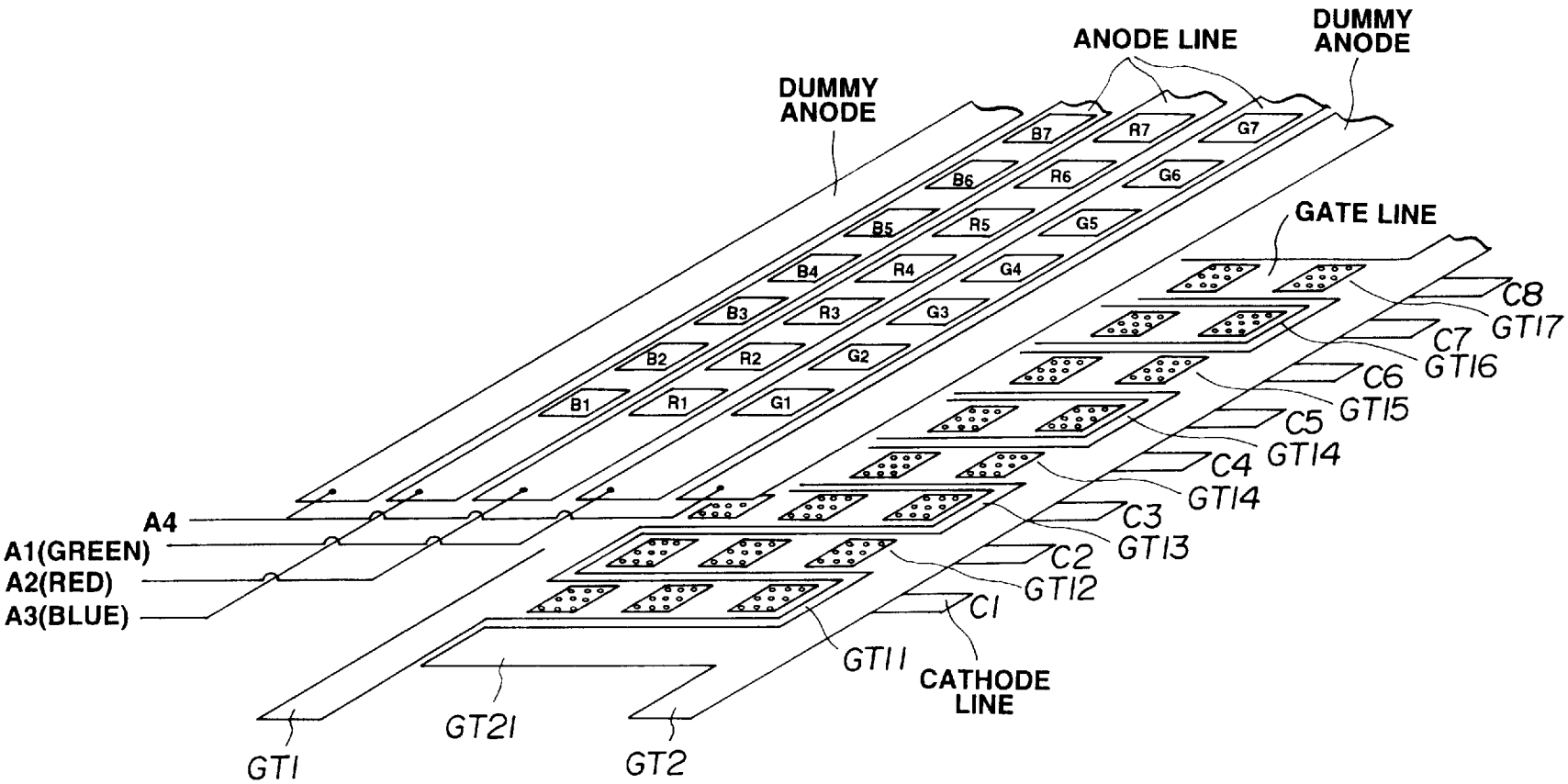
FIG. 4 is a perspective view showing the structures of the gate lines, the cathode lines and anode lines of the field emission print head according to the first embodiment of the present invention.

FIG. 4 is a perspective view of the field emission print head according to the first embodiment of the present invention. FIG. 4 shows only various electrodes formed on the anode substrate 10 and the cathode substrate 1 while omitting the other structures.

As shown in FIG. 4, the three anode lines A1, A2 and A3 are formed into stripe shape which runs perpendicular to the cathode lines C1 to Cn and gate lines GT11 to GT1n. On the two sides of the anode lines A1, A2 and A3, the dummy anodes A4 are formed.

The anode line A1 is arranged to emit G (green) light component, the anode line A1 having dot-like fluorescent members G1 to Gn formed opposite to the gate lines GT11 to GT1n. The anode line A2 is arranged to emit R (red) light component, while the anode line A3 is arranged to emit B (blue) light component. The anode lines A2 and A3 have corresponding dot-like fluorescent members R1 to Rn and fluorescent members B1 to Bn formed opposite to the gate lines GT11 to GT1n.

The dummy anodes A4 are arranged to converge electrons which reach the anode lines A1, A2 and A3, the dummy anodes A4 always having a low potential (or zero level or a negative level).

In the foregoing case, the fluorescent members G1 to Gn, R1 to Rn and B1 to Bn may be fluorescent members capable of respectively emitting green, red and blue light components. As an alternative to this, red, green and blue optical filters may be disposed on the inside of the anode substrate 10 to correspond to the fluorescent members G1 to Gn, R1 to Rn and B1 to Bn so as to obtain red, green and blue emission light components.

Note that the gate lines GT11 to GT1n have dot-shape field emission arrays (indicated by a small and white circle group) formed opposite to the fluorescent members G1 to Gn, R1 to Rn and B1 to Bn.

The method of operating the field emission print head according to the first embodiment of the present invention will schematically be described. Initially, the anode line A1 is selected and operated, and the potentials of the anode lines A2 and A3 and the dummy anodes A4 are made to be the low levels. In the foregoing state, green (G) image data for one line is supplied to the cathode lines C1 to Cn, followed by selecting and operating the first gate lead electrode GT1. Then, the second gate lead electrode GT2 is selected and operated.

As a result, light emission of each of the odd order fluorescent members G1, G3, G5, . . . , G (n−1) is controlled in accordance with green image data. Then, light emission of each of the even order fluorescent members G2, G4, G6, . . . , Gn is controlled in accordance with green image data.

Then, the anode line A2 is selected and operated, and the potentials of the anode lines A1 and A3 and the dummy anodes A4 are made to be the low levels. In the foregoing state, red (R) image data for one line is supplied to the cathode lines C1 to Cn, followed by selecting and operating the first gate lead electrode GT1. Then, the second gate lead electrode GT2 is selected and operated.

As a result, light emission of each of the odd order fluorescent members R1, R3, R5, . . . , R (n−1) is controlled in accordance with red image data. Then, light emission of each of the even order fluorescent members R2, R4, R6, . . . , Rn is controlled in accordance with red image data.

Then, the anode line A3 is selected and operated, and the potentials of the anode lines A1 and A2 and the dummy anodes A4 are made to be the low levels. In the foregoing state, blue (B) image data for one line is supplied to the cathode lines C1 to Cn, followed by selecting and operating the first gate lead electrode GT1. Then, the second gate lead electrode GT2 is selected and operated.

As a result, light emission of each of the odd order fluorescent members B1, B3, B5, . . . , B (n−1) is controlled in accordance with blue image data. Then, light emission of each of the even order fluorescent members B2, B4, B6, . . . , Bn is controlled in accordance with blue image data.

As a result, a color image for one line is displayed on the print head so that the color image is recorded on a recording medium. Then, line sequential scanning is sequentially performed so that a color image for one picture screen is recorded on the recording medium.

Note that the anode lines A1, A2 and A3 may be scanned in place of scanning the gate lead electrodes GT1 and GT2. That is, the anode lines A1 to A3 are sequentially scanned during a period in which the first gate lead electrode GT1 is selected and operated. In this case, image data items of colors corresponding to the cathode lines C1 to Cn are sequentially supplied correspondently to the scanning of the anode lines A1 to A3. Then, the second gate lead electrode GT2 is selected and operated, and the anode lines A1 to A3 are scanned. By operating the field emission print head as described above, color image data for one image screen may be recorded on a recording medium.

Since the selected and operated anode line is held between low level (or zero level or a negative level) anode lines or the dummy anodes A4, electrons which reach the selected and operated anode line can be converged.

The anode lines A1 to A4 according to the first embodiment are made of transparent electrode material, such as ITO, while the anode substrate 10 is made of transparent glass. A structure may be employed in which the anode lines A1 to A4 are made of thin films made of metal, such as aluminum, and a window is formed in a thin film portion having the dot-like fluorescent member to transmit light emitted from the fluorescent member through the window.

Since a precise light emission pattern can be obtained in the foregoing case though the structure is formed by the thin film, the permissible range for the accuracy in patterning the fluorescent members can be widened.

The two adjacent odd order and even order cathode lines among the cathode lines C1 to Cn may be connected to each other to enable the two cathode lines to be operated by one driver. By employing the foregoing means, the number of the cathode drivers may be halved.

A second embodiment of the field emission print head according to the present invention will now be described with reference to FIGS. 5 and 6.

Figure 5:
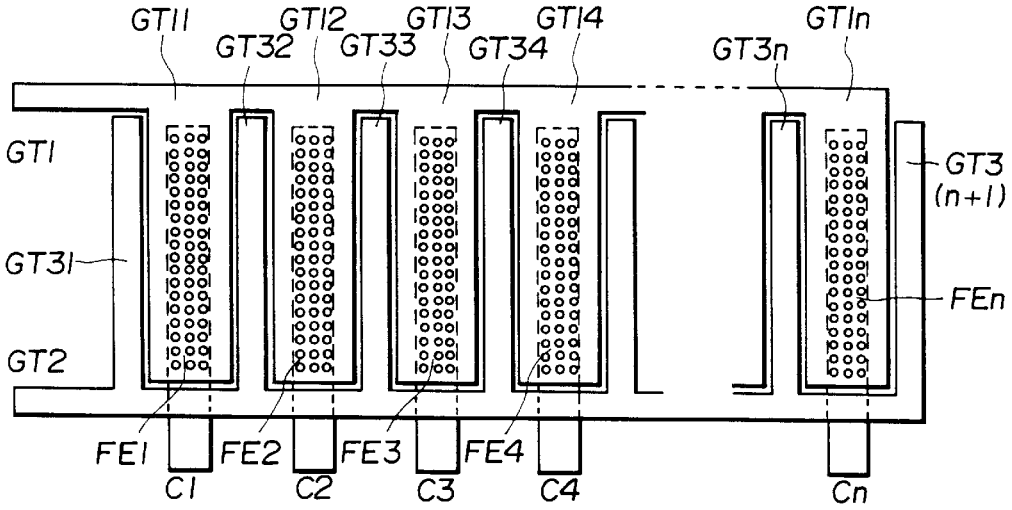
FIG. 5 shows the structures of gate lines and cathode lines of a field emission print head according to a second embodiment of the present invention.

FIG. 5 shows the structures of cathode lines C1 to Cn and gate lines GT11 to GT1n according to the second embodiment. Similarly to the first embodiment, n cathode lines C1 to Cn are formed on the cathode substrate in such a manner that the intervals of the cathode lines C1 to Cn are made to be somewhat larger than those employed in the first embodiment.

On the cathode lines C1 to Cn, there are formed the gate lines GT11 to GT1n through an insulating layer. The width of each of the gate lines GT11 to GT1n is larger than that of each of the cathode lines C1 to Cn. Moreover, portions, in which the cathode lines C1 to Cn and the gate lines GT11 to GT1n overlap, stripe-shape field emission arrays FE1 to FEn are formed in place of the dot-shape field emission arrays.

In the second embodiment of the present invention, all of the gate lines GT11 to GT1n are connected to the first gate lead electrode GT1. To converge electrons emitted from the field emission arrays FE1 to FEn of the gate lines GT11 to GT1n, converging electrodes GT31 to GT3 (n+1) are disposed between the gate lines GT11 to GT1n and on the two sides of the same.

The converging electrodes GT31 to GT3 (n+1) are connected to the second gate lead electrode GT2. To cause the converging electrodes GT31 to GT3 (n+1) to converge emitted electrons, the potential of each of the converging electrodes GT31 to GT3 (n+1) is made to be a low level (or zero level or a negative level) by causing the potential of the second gate lead electrode GT2 to be always a low level (or zero level or a negative level).

Figure 6:
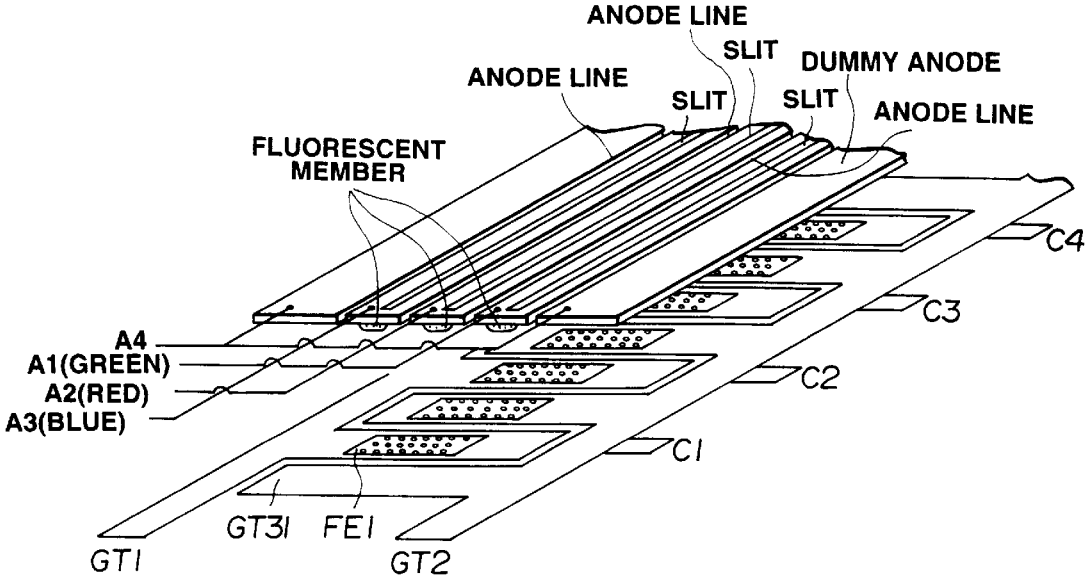
FIG. 6 is a perspective view showing the structures of the gate lines, the cathode lines and anode lines of the field emission print head according to the second embodiment of the present invention.

FIG. 6 is a perspective view showing the second embodiment of the present invention, in which the structures of the cathode line C1 to Cn and the gate lines GT11 to GT1n and those of the anode lines A1 to A4 are illustrated.

As shown in FIG. 6, the three anode lines A1 to A3 are disposed in a stripe configuration which runs perpendicular to the cathode line C1 to Cn and the gate lines GT11 to GT1n. Moreover, dummy anodes A4 for converging electrons are formed on the two sides of the anode lines A1 to A3.

The anode line A1 is capable of emitting green (G) light component. The anode line A1 is coated with dot-like fluorescent members G1 to Gn formed in a stripe configuration in the axial direction of the anode line A1. The anode line A2 is capable of emitting red (R) light component, while the anode line A3 is capable of emitting blue (B) light component. Each of the anode lines A2 and A3 is coated with fluorescent members R1 to Rn or fluorescent members B1 to Bn formed into an elongated and stripe configuration in their axial directions.

Each of the anode lines A1 to A3 made of metal, such as aluminum, has an elongated slit in the axial direction thereof to correspond to the elongated fluorescent member. The slit permits light emitted from the fluorescent member to pass through.

The second embodiment of the present invention has the structure such that the field emission cathodes FE1 to FEn of the gate lines GT11 to GT1n are formed into a stripe configuration for red, green and blue light components. Moreover, the fluorescent members coating the anode lines A1 to A3 are formed into elongated shapes in their axial directions. Therefore, the permissible range for positioning the anode substrate 10 and the cathode substrate 1 can be widened when the field emission print head is manufactured. Therefore, the field emission print head according to the second embodiment can easily be manufactured.

Since the anode lines A1 to A3 have elongated slits in the axial directions thereof to enable light emitted from the fluorescent members to pass through, the permissible range for positioning the fluorescent members with respect to the anode lines A1 to A3 can be widened when the field emission print head is manufactured. Thus, the fluorescent members can easily be formed to coat the anode lines A1 to A3.

Note that the respective fluorescent members with which the anode lines A1 to A3 are coated may be fluorescent members capable of emitting green, red and blue light components. As an alternative to this, red, green and blue optical filters may be disposed on the inner surface of the anode substrate 10 to correspond to the anode lines A1 to A3 to obtain red, green and blue light components from the anode lines A1 to A3.

The method of operating the field emission print head according to the second embodiment of the present invention will schematically be described. Initially, the anode line A1 is selected and operated, and the potential of the anode lines A2 and A3 and the dummy anodes A4 is made to be a low level (or zero level or a negative level). In this state, green (G) image data for one line is supplied to the cathode line C1 to Cn, and the first gate lead electrode GT1 is operated. At this time, the potential of the second gate lead electrode GT2 is always made to be a low level (or zero level or a negative level).

As a result, light emission of the fluorescent member coating the anode line A1 is controlled in accordance with green image data.

Then, the anode line A2 is selected and operated, and the potential of the anode lines A1 and A3 and the dummy anodes A4 is made to be a low level (or zero level or a negative level). In this state, red image data for one line is supplied to the cathode line C1 to Cn, and the first gate lead electrode GT1 is operated. As a result, light emission of the fluorescent member coating the anode line A2 is controlled in accordance with red image data.

Then, the anode line A3 is selected and operated, and the potential of the anode lines A1 and A2 and the dummy anodes A4 is made to be a low level (or zero level or a negative level). In this state, blue image data for one line is supplied to the cathode line C1 to Cn, and the first gate lead electrode GT1 is operated. As a result, light emission of the fluorescent member coating the anode line A3 is controlled in accordance with blue image data.

As a result, a color image for one line is transmitted to the field emission print head according to the second embodiment. Transmitted light enables the image to be recorded on a recording medium. Then, line sequential scanning is sequentially performed similarly so that a color image for one image screen is recorded on the recording medium.

The field emission print head according to the first embodiment of the present invention has the structure such that the potential of the gate lines is alternatively made to be a low level (or zero level or a negative level) and the potential of the non-selected anode lines and the dummy anodes is made to be a low level (or zero level or a negative level). The second embodiment is arranged such that converging electrodes, the potential of each of which is always a low level (or zero level or a negative level), are disposed between the gate lines and the potential of the non-selected anode lines and the dummy anodes is made to be a low level (or zero level or a negative level). Therefore, electrons emitted from the field emission array can be converged and allowed to collide with the fluorescent members.

As a result, leakage light emission can be prevented and therefore the intervals of the fluorescent members corresponding to the respective colors can be reduced.

For example, the line pitch between green and red anode lines and between red and blue anode lines can be made to be about 147 $\mu$m, while the same between green and blue anode lines can be made to be about 294 $\mu$m. As a result, a low cost SELFOC array can be employed to focus light emitted from the field emission print head onto the recording medium.

Figure 9:
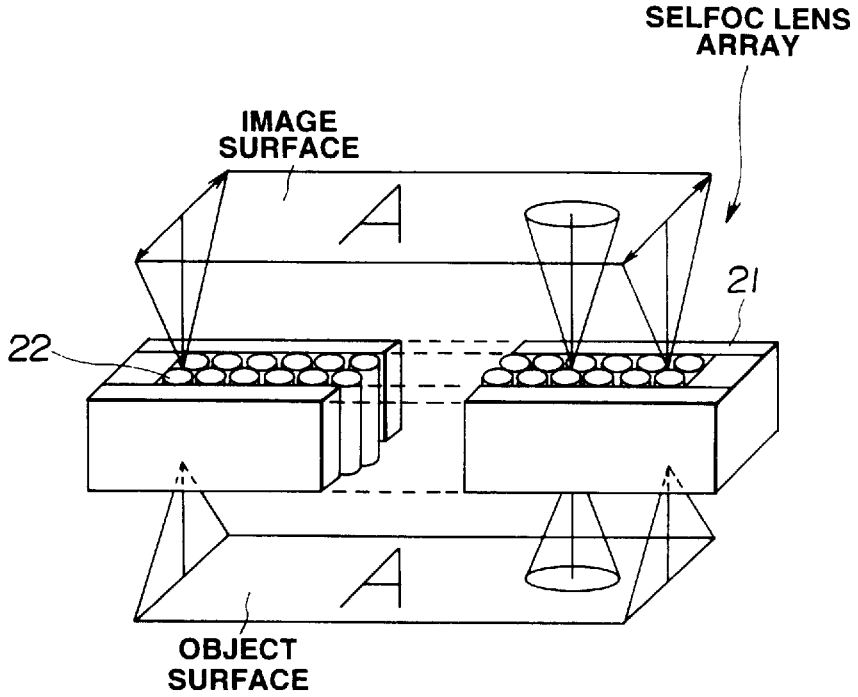
FIG. 9 is a perspective view showing the structure of the SELFOC lens array consisting of lenses arranged into two lines.

The reason for this will now be described. FIG. 9 is a perspective view showing the structure of a SELFOC lens array. The SELFOC lens array is composed of single lenses 22 in the array configuration disposed in a line and a frame 21 for integrally holding the array of the single lenses 22.

The SELFOC lens array is structured such that an erecting and the same magnification image "A" is projected to the image surface on which the image is formed when "A" is displayed on the object surface as illustrated.

Figure 7:
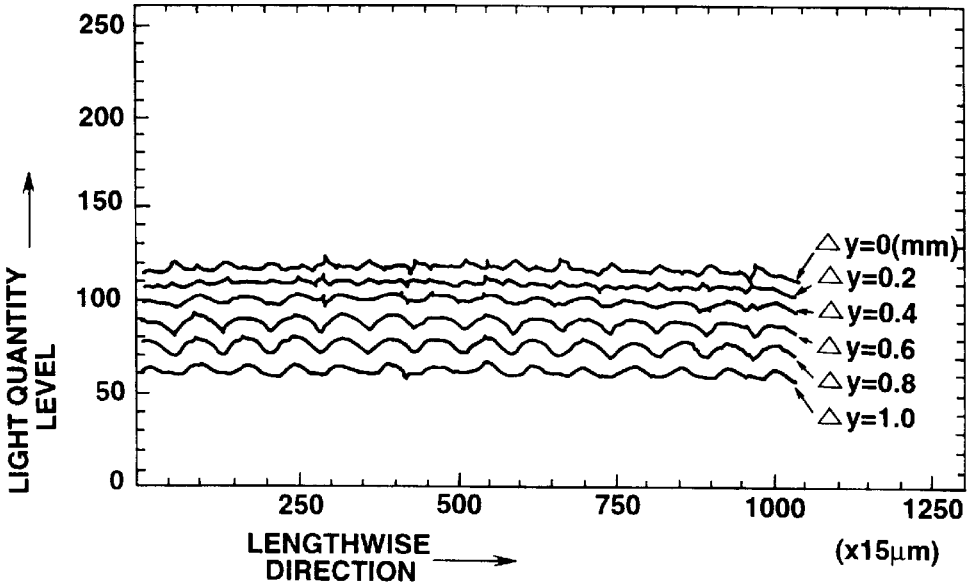
FIG. 7 is a graph showing the characteristics of a SELFOC lens array consisting of lenses arranged into a single line.
Figure 8:
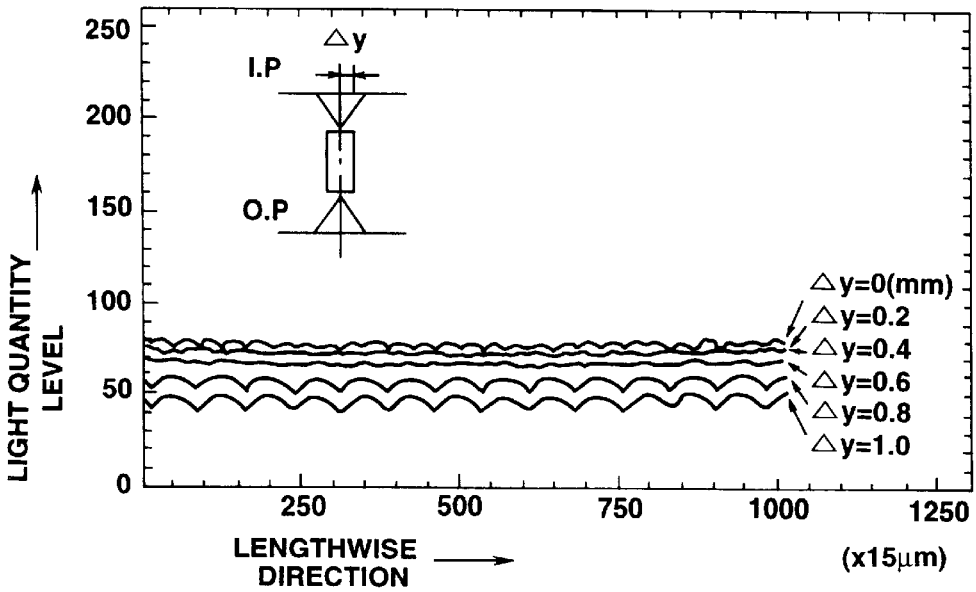
FIG. 8 is a graph showing the characteristics of a SELFOC lens array consisting of lenses arranged into two lines.

Although the SELFOC lens array is composed of single lenses 22 arranged into two lines, the configuration is not limited to this. Some SELFOC lens arrays are composed of single lenses arranged into a single line or a three or more lines. FIG. 7 is a graph showing the relationship between displacement amount $\Delta y$ of incidental light from the center line of the SELFOC lens array consisting of lenses arranged into a single line and irregularity in the light quantity. FIG. 8 is a graph showing the relationship between displacement amount $\Delta y$ of incidental light from the center line of the SELFOC lens array consisting of lenses arranged into two lines and irregularity in the light quantity.

With the SELFOC lens array consisting of lenses arranged into a single line, a preferred quantity of permissible displacement amount $\Delta y$ is 0.4 mm (400 $\mu$m) or smaller in view of the irregularity in the light quantity shown in FIG. 7. With the SELFOC lens array consisting of lenses arranged into two lines, a preferred quantity of permissible displacement amount $\Delta y$ is 0.6 mm (600 $\mu$m) or smaller in view of the irregularity in the light quantity shown in FIG. 8.

Therefore, the field emission print head according to the present invention enables the irregularity in the light quantity to be reduced into a permissible range even if a low cost SELFOC lens array is employed.

Note that the conventional field emission print head is required to make the line pitch to be 200 $\mu$m or longer to prevent leakage light emission. Therefore, a costly SELFOC lens array consisting of lenses arranged into two or more lines has been required.

The field emission print head according to the present invention has the structure such that he pixel pitch is about 42 $\mu$m, the number of pixels is about 5,040 and the effective length is about 213 mm when the resolution is 600 dpi.

The fluorescent member in the case where the optical filter may be ZnO; Zn. As the optical filter, an interference film or a pigment filter may be employed. In this case, the difference in the quantity of light emission among red, green and blue color components may be corrected by making the voltages for operating the three anode lines to be different from one another or by controlling the pulse width of emitted light.

In the case where the anode lines and the dummy anodes are made of thin aluminum films, a reflection preventive film may be formed in the interface between the thin aluminum film and the anode substrate to improve the contrast.

As described above, the field emission print head according to the present invention has the structure such that the odd order gate lines and even order gate lines are separated from one another and alternately selected and operated. Simultaneously, also the plural anode electrodes are sequentially selected and operated. By making the potential of the non-selected gate lines and the non-selected anode lines to be a low level (or zero level or a negative level), electrons field-emitted from the gate lines are not dispersed but the same are converged.

When the converging gate electrodes, the potential of each of which is always low (or zero level or a negative level), are disposed between the plural gate lines, dispersion of field-emitted electrons can be prevented and the electrons can be converged.

When the field emission array is formed into a stripe configuration in the axial direction of the gate line in place of the dot-like shape and the anode lines are coated with the fluorescent members in the elongated shape in the axial direction, the permissible range for positioning the anode substrate with respect to the cathode substrate and that for positioning the fluorescent members with respect to the anode lines can be widened.

Since field-emitted electrons can be converged, the pixel pitch can be reduced. Thus, a low cost SELFOC lens array can be employed.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A field emission print head, comprising:

a plurality of cathode lines formed on a cathode substrate;

a plurality of emitters formed on said cathode lines;

a plurality of gate lines formed on said cathode substrate through an insulating layer at positions opposite to said cathode lines, said gate lines being disposed adjacent to leading ends of said plural emitters;

a first gate lead electrode formed coplanar with said plurality of gate lines and connected to odd order gate lines of said plurality of gate lines;

a second gate lead electrode formed coplanar with said plurality of gate lines and connected to even order gate lines of said plurality of gate lines, wherein said even and said odd order gate lines are patterned to be interdigitated with each other, whereby when the even and odd order lines are alternately selected non-selected lines receive a lower potential than selected gate lines to thereby accelerate electrons emitted from the selected gate lines to be converged by the potential of the non-selected gate lines in a first scanning direction;

a plurality of anode lines formed on an anode substrate disposed opposite to said cathode substrate;

a first dummy anode formed on a first side of said plurality of anode lines and a second dummy anode formed on a second side of said plurality of anode lines wherein said first side is opposite to said second side;

fluorescent members covering a portion of an anode line which is opposite to said gate lines, whereby when said first gate lead electrode and said second gate lead electrode are alternately selected and operated, said plurality of anode lines are sequentially selected and operated and potentials of non-selected gate lead electrodes and non-selected anode lines and said dummy anode lines are at a low level to thereby permit electrons emitted from said plurality of emitters to be converged toward selected ones of said anode by said low level potential of said non-selected anodes and said dummy electrodes in a second scanning direction.

2. A field emission print head comprising:

a plurality of cathode lines formed on a cathode substrate;

a plurality of emitters formed on said cathode lines;

a plurality of gate lines formed on said cathode substrate through an insulating layer at positions opposite to said cathode lines, said gate lines being disposed adjacent to leading ends of said plural emitters;

a plurality of converging electrodes with one of said plurality of converging electrodes disposed between each pair of adjacent ones of said gate lines and one of said plurality of converging electrodes disposed on each of two sides of said first gate lines;

a first gate lead electrode formed coplanar with said plurality of gate lines and connected to said plural gate lines;

a second gate lead electrode formed coplanar with said plurality of gate lines and connected to said plural converging electrodes, wherein said gate lines and said converging electrodes are patterned to be interdigitated with each other, whereby when the gate lines and the converging electrodes are alternately selected, non-selected lines or electrodes receive a lower potential than selected gate lines or electrodes to thereby accelerate electrons emitted from the selected gate lines or electrodes to be converged by the potential of the non-selected gate lines or electrodes in a first scanning direction;

a plurality of anode lines formed on an anode substrate disposed opposite to said cathode substrate;

a first dummy anode formed on a first side of said plurality of anode lines and a second dummy anode formed on a second side of said plurality of anode lines wherein said first side is opposite to said second side; and elongated fluorescent members covering said anode lines in an axial direction of said anode lines, whereby when any one of said plural anode lines is selected and operated to correspond to color image data supplied to said cathode lines, potentials of said second gate lead electrode, non-selected anode lines and said dummy anodes are at low levels to thereby permit electrons emitted from said emitters to be converged toward a selected anode by said low level potential of said non-selected anode and said dummy electrodes in a second scanning direction.

3. A field emission print head according to claim 2, wherein said plural anode lines are made of non-transparent conductive materials in such a manner that slits are formed in the axial direction of said anode lines, and said plural anode lines are covered with said fluorescent members to cover said slits.

* * * * *